US006295743B1

(12) United States Patent
Brooks

(10) Patent No.: US 6,295,743 B1
(45) Date of Patent: Oct. 2, 2001

(54) BOOT WITH HEEL-BACK FASTENING MECHANISM

(76) Inventor: Marc D. Brooks, 2609 Robyns Dr., Charlotte, NC (US) 28228

( * ) Notice: Subject to any disclaimer, the term of this patent is extended or adjusted under 35 U.S.C. 154(b) by 0 days.

(21) Appl. No.: 09/522,230

(22) Filed: Mar. 9, 2000

Related U.S. Application Data

(63) Continuation of application No. 09/059,516, filed on Apr. 13, 1998, now abandoned.

(51) Int. Cl.[7] ..... A43B 21/00
(52) U.S. Cl. ..... 36/105; 36/50.1
(58) Field of Search ..... 36/50.1, 50.5, 36/105, 99, 97

(56) References Cited

U.S. PATENT DOCUMENTS

| | | | | |
|---|---|---|---|---|
| 645,467 | * | 3/1900 | Fowler | 36/50.1 |
| 772,947 | | 10/1904 | Martin . | |
| 899,978 | | 9/1908 | Hessler . | |
| 1,479,884 | | 1/1924 | Zern . | |
| 2,666,996 | | 1/1954 | Odland . | |
| 3,545,107 | * | 12/1970 | Cinquegrana et al. | 36/50.1 |
| 4,512,089 | | 4/1985 | Carrier . | |
| 5,384,971 | | 1/1995 | Ferry . | |
| 5,832,632 | | 11/1998 | Bergeron . | |

FOREIGN PATENT DOCUMENTS

| | | | | |
|---|---|---|---|---|
| 430494 | | 8/1967 | (DE) . | |
| 1375576 | * | 9/1964 | (FR) | 36/50.5 |

* cited by examiner

*Primary Examiner*—Luan K. Bui
*Assistant Examiner*—J. Mohandesi
(74) *Attorney, Agent, or Firm*—Adams, Schwartz & Evans, P.A.

(57) ABSTRACT

A boot with a heel-back fastening mechanism has a split heel-back through which the foot of the user is inserted into the foot receiving cavity of the boot shell. The boot includes a boot shell having a heel cup secured to a sole assembly. The boot shell has a split heel-back that forms a boot shell left side and a boot shell right side. The heel-back fastening mechanism includes a flexible heel center member, a plurality of heel securing straps, and a plurality of heel securing grommets. The flexible heel center member extends away from the heel cup and is sealingly connected between the left and right sides of the boot shell. The plurality of heel securing straps each has an end secured to one of the boot shell sides. Each of the heel securing grommets is secured through a side of the boot shell opposite the point of attachment for each end of the plurality of heel straps. Each of the plurality of heel securing straps includes first and second companionate sections of hook and pile fastener material.

4 Claims, 3 Drawing Sheets

BOOT WITH HEEL-BACK FASTENING MECHANISM

This application is a continuation of Ser. No. filed Apr. 13, 1998 now abandon.

TECHNICAL FIELD

The present invention relates to boots and fastening mechanisms for boots and more particularly a boot with a heel-back fastening mechanism, the boot including a boot shell having a heel-cup secured to a sole assembly, the boot shell having a split heel-back that forms a boot shell left side and a boot shell right side; the heel-back fastening mechanism including a flexible heel center member, a plurality of heel securing straps, and a plurality of heel securing grommets; the flexible heel center member extending away from the heel cup and sealingly secured along the entire length of both side edges thereof between the left and right sides of the boos shell; the plurality of heel securing straps each having an end secured to one of the boot shell sides; each of the heel securing grommets being secured through a side of the boot shell opposite the point of attachment for each end of the plurality of heel straps; each of the plurality of heel securing straps including first and second companionate sections of hook and pile fastener material.

BACKGROUND ART

It is often difficult to remove and put on work boots that extend over the ankle. Although it is difficult to put on and remove such work boots, the added support to the wearer's ankles can be very beneficial. It would be a benefit, therefore, to have a boot that included a split heel-back to enable a wearer to more easily put on and remove work boots.

GENERAL SUMMARY DISCUSSION OF INVENTION

It is thus an object of the invention to provide a boot with heel-back fastening mechanism.

It is a further object of the invention to provide a boot with heel-back fastening mechanism that has split heel-back through which the foot of the user is inserted into the foot receiving cavity of the boot shell.

It is a still further object of the invention to provide a boot with heel-back fastening mechanism that includes a boot shell having a heel cup secured to a sole assembly, the boot shell having a split heel-back that forms a boot shell left side and a boot shell right side; the heel-back fastening mechanism including a flexible heel center member, a plurality of heel securing straps, and a plurality of heel securing grommets; the flexible heel center member extending away from the heel cup and sealingly secured along the entire length of both side edges thereof between the left and right sides of the boot shell; the plurality of heel securing straps each having an end secured to one of the boot shell sides; each of the heel securing grommets being secured through a side of the boot shell opposite the point of attachment for each end of the plurality of heel straps; each of the plurality of heel securing straps including first and second companionate sections of hook and pile fastener material.

It is a still further object of the invention to provide a boot with heel-back fastening mechanism that accomplishes some or all of the above objects in combination.

Accordingly, a boot with heel-back fastening mechanism is provided. The boot with heel-back fastening mechanism includes a boot shell having a heel cup secured to a sole assembly, the boot shell having a split heel-back that forms a boot shell left side and a boot shell right side; the heel-back fastening mechanism including a flexible heel center member, a plurality of heel securing straps, and a plurality of heel securing grommets; the flexible heel center member extending away from the heel cup and sealingly secured along the entire length of both side edges thereof between the left and right sides of the boot shell; the plurality of heel securing straps each having an end secured to one of the boot shell sides; each of the heel securing grommets being secured through a side of the boot shell opposite the point of attachment for each end of the plurality of heel straps; each of the plurality of heel securing straps including first and second companionate sections of hook and pile fastener material.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
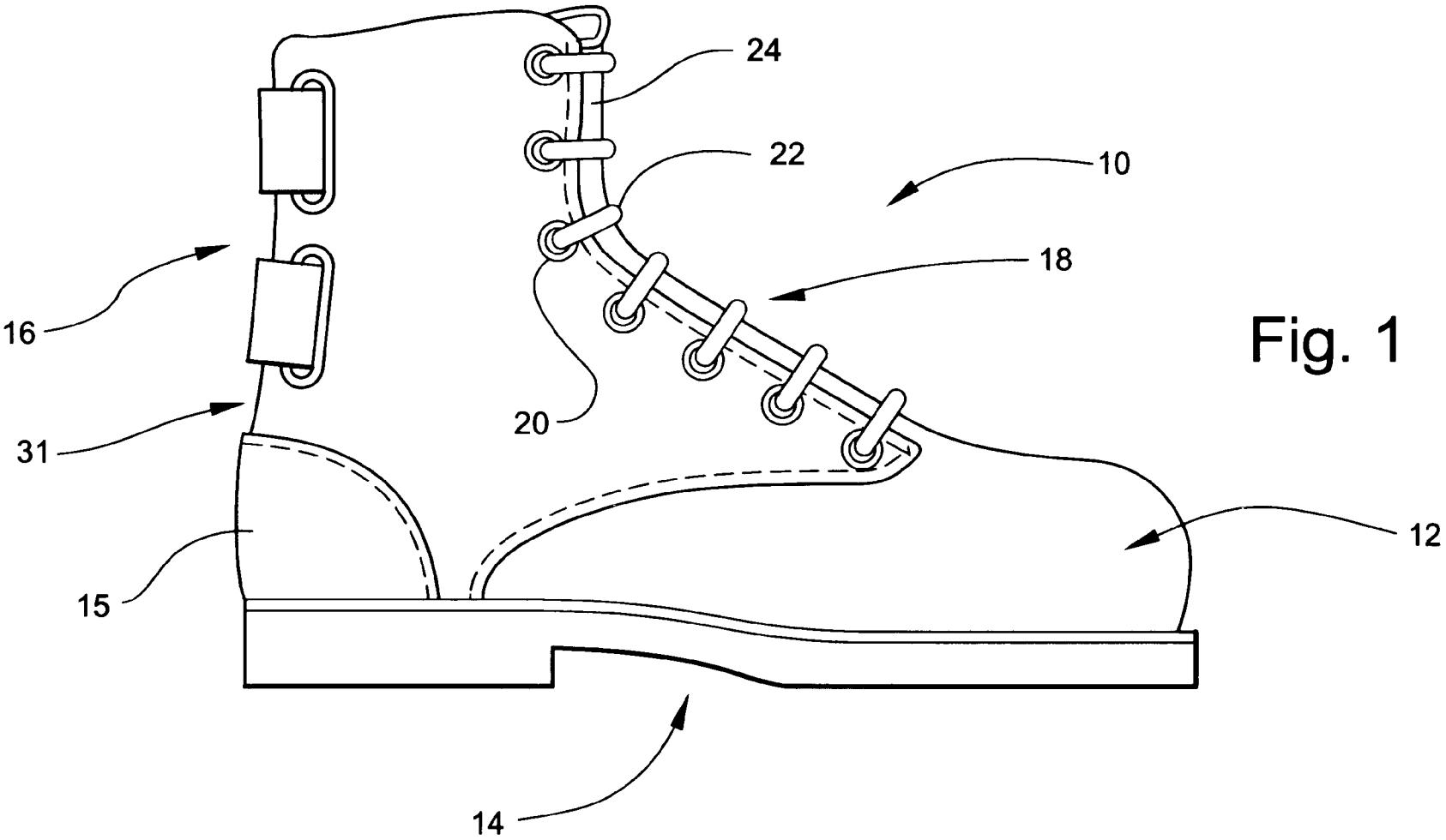
FIG. 1 is a side plan view of an exemplary embodiment of the boot with heel-back fastening mechanism of the present invention showing the boot shell including the front lace structure including the conventional lace eyelets, boot lace and boot tongue; the heel cup, the sole assembly and the heel-back fastening mechanism including the heel curing grommets, the two heel securing straps, and the heel center member.

FIG. 1 shows an exemplary embodiment of the boot with heelback fastening mechanism of the present invention generally designated by the numeral 10. In this embodiment boot 10 includes a boot shell, generally designated 12, a sole assembly, generally designated 14, a heel cup 15, and a heel-back fastening mechanism, generally designated 16. Boot shell 12 is of leather construction and includes a front lace structure, generally designated 18, including conventional lace eyelets 20, a boot lace 22 and a boot tongue 24.

Figure 2:
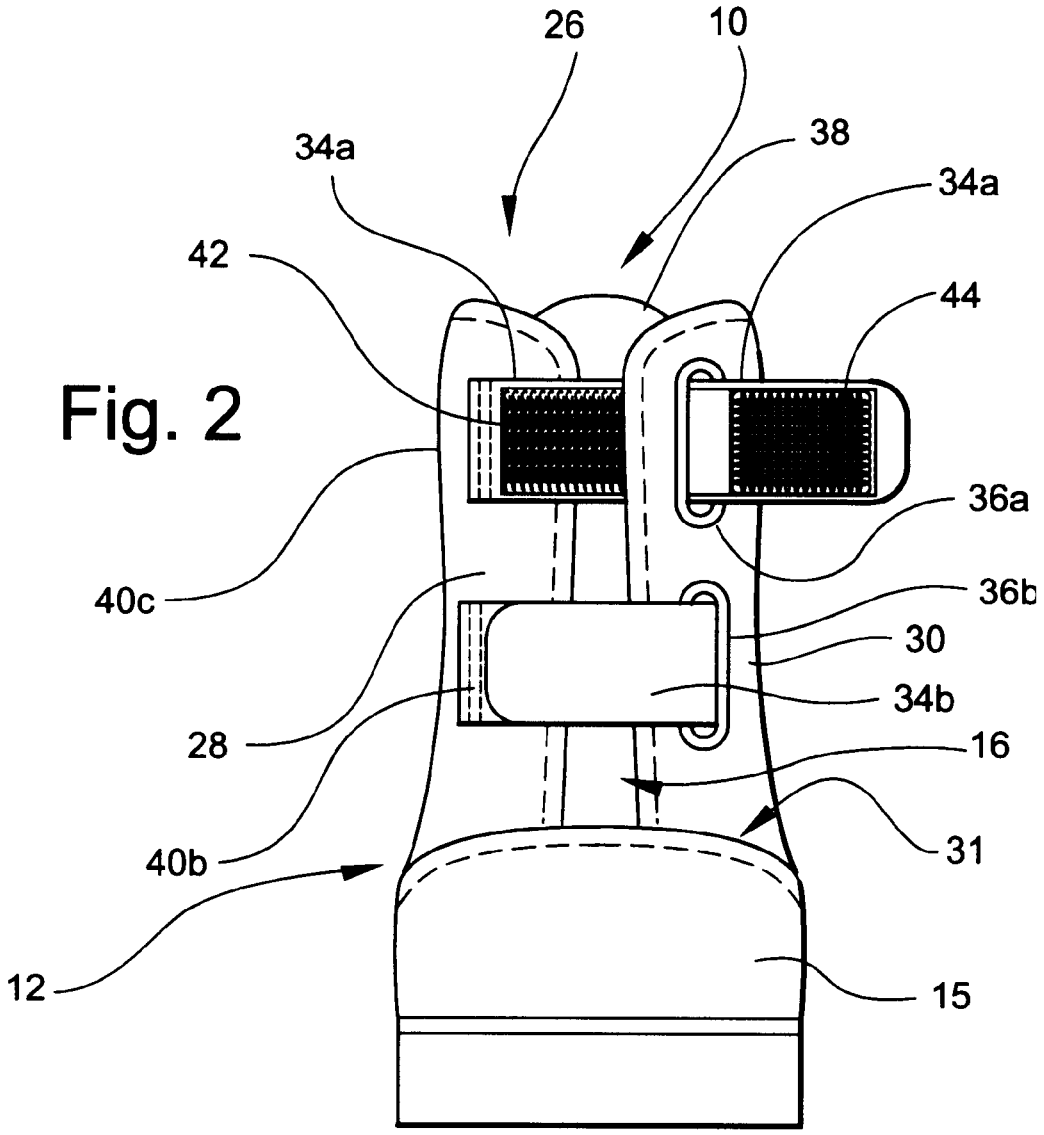
FIG. 2 is a rear plan view of the boot of FIG. 1 showing the heel-back fastening mechanism including the two heel securing straps each having an end stitched to the left side of the boot shell and each including first and second section of hook and pile fastener material, the two heel securing grommets secured through the right side of the boot shell, and the flexible leather heel center member extending upwardly from the heel cup.

With reference to FIG. 2, the heel-back, generally designated 26 of boot shell 12 is split to form a left boot shell side 28 and a right boot shell side 30. The left and right shell sides 28 and 30 are formed in laterally spaced-apart relation at a top heel portion 31 of the boot 10 and extend upwardly to a top of the raised heel-back 26. Heel-back fastening mechanism 16 is used to maintain left and right boot shell sides 28, 30 against the ankle of the wearer. Heel-back fastening mechanism 16 includes two heel Securing straps, generally designated 34*a*, 34*b*; two heel securing grommets, generally designated 36*a*, 36*b* and a flexible leather heel center member 38 having a width greater than the gap between left and right boot shell sides 28, 30.

In this embodiment, each heel securing strap 34*a*, 34*b* is constructed of a length of woven nylon strapping material having a first end 40*a*, 40*b* stitched to left boot shell side 28. Each heel securing strap includes a first section 42 and a companionate second section 44 of hook and pile fastener material on one side surface thereof that is positioned such that second section 44 is positionable through a respective heel securing grommet 36*a*, 36*b* and then foldable back into securing contact with first section 42 and to thereby hold left and right boot shell sides 28, 30 against the wearer's ankle.

Figure 3:
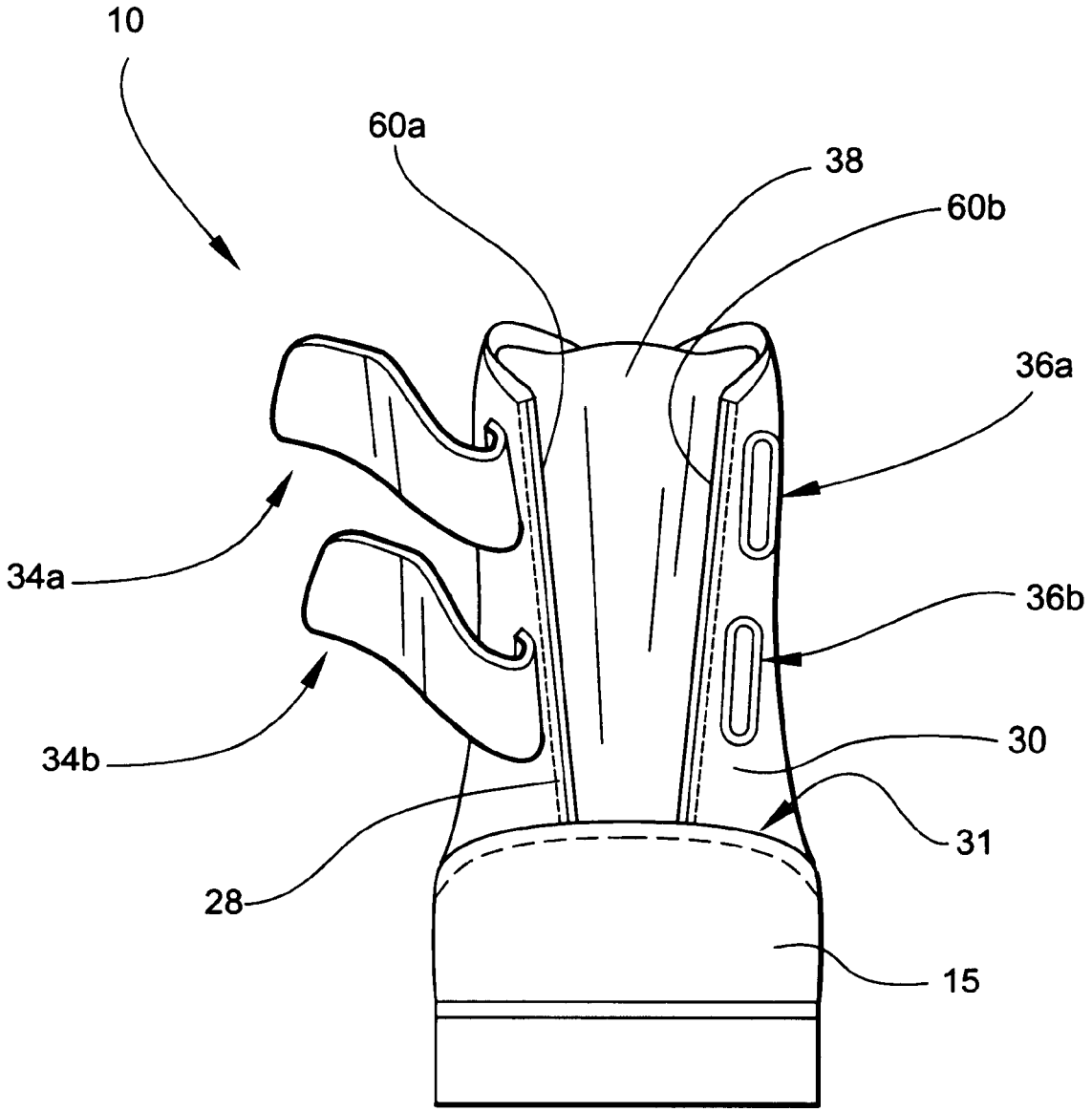
FIG. 3 is a rear plan view of the boot of FIG. 2 showing the two heel securing straps folded back and free of the two heel securing grommets, and the left and right sides of the boot shell folded back and outwardly to reveal the flexible leather heel center member stretched therebetween.

With reference now to FIG. 3, flexible leather heel center member 38 is sealingly connected along the entire side edge 60*a* to left boot shell side 28 and along the entire side edge 60*b* to right boot shell side 30 with waterproof adhesive and stitching.

It can be seen from the preceding description that a boot with heel-back fastening mechanism has been provided that has split heel-back through which the foot of the user is inserted into the foot receiving cavity of the boot shell; and that includes a boot shell having a heel cup secured to a sole assembly, the boot shell having a split heel-back that forms a boot shell left side and a boot shell right side; the heel-back fastening mechanism including a flexible heel center member, a plurality of heel securing straps, and a plurality of heel securing grommets; the flexible heel center member extending away from the heel cup and sealingly secured along the entire length of both side edges thereof between the left and right sides of the boot shell; the plurality of heel securing straps each having an end secured to one of the boot shell sides; each of the heel securing grommets being secured through a side of the boot shell opposite the point of attachment for each end of the plurality of heel straps; each of the plurality of heel securing straps including first and second companionate sections of hook and pile fastener material.

It is noted that the embodiment of the boot with heel-back fastening mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

I claim:

1. A boot comprising:

(a) a sole assembly;

(b) a boot shell attached to said sole assembly, and defining a foot-receiving cavity adapted for receiving a foot of a wearer;

(c) a raised heel-back formed with said boot shell and adapted for extending upwardly beyond a heel of the foot to provide added support for an ankle of the wearer;

(d) said raised heel-back being spilt to define spaced-apart left and right boot shell sides, said left and right boot shell sides being formed in laterally spaced-apart relation at a top heel portion of said boot and extending to a top of said raised heel-back, and cooperating to adjustably open a rear of said boot to enlarge the foot-receiving cavity of said boot shell, thereby facilitating insertion and removal of the foot into and from said boot;

(e) an adjustable heel-back fastening mechanism engaging said left and right boot shell sides above the top heel potion of said boot for adjustably closing the rear of said boot, thereby adjusting the fit of said raised heel-backing against the ankle of the wearer; and (f) a boot front having an adjustable front fastening mechanism, said front fastening mechanism cooperating with said rear fastening mechanism to provide a multi-adjustable front and rear fitting system for conforming said boot to the foot.

2. A boot according to claim 1, wherein said heel-back fastening mechanism comprises a support strap attached to one of said right and left boot shell sides, and adapted for extending to and engaging the other of said right and left boot shell sides to releasably close the rear of said boot.

3. A boot according to claim 1, and comprising a flexible heel-back center member located between said right and left boot shell sides.

4. A boot according to claim 1, and comprising a heel cup located at a base of said raised heel-back.

* * * * *